US007648258B2

(12) United States Patent
Shuai et al.

(10) Patent No.: US 7,648,258 B2
(45) Date of Patent: Jan. 19, 2010

(54) LED LAMP WITH IMPROVED HEAT SINK

(75) Inventors: Chun-Jiang Shuai, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 1 day.

(21) Appl. No.: 12/024,956

(22) Filed: Feb. 1, 2008

(65) Prior Publication Data

US 2009/0196045 A1 Aug. 6, 2009

(51) Int. Cl.
*F21V 29/00* (2006.01)

(52) U.S. Cl. ..... 362/294; 362/249.02; 362/373

(58) Field of Classification Search ..... 362/249.01, 362/249.02, 800, 294, 373
See application file for complete search history.

(56) References Cited

U.S. PATENT DOCUMENTS

| | | | | |
|---|---|---|---|---|
| 6,787,999 | B2 * | 9/2004 | Stimac et al. | 315/51 |
| 2004/0066142 | A1 * | 4/2004 | Stimac et al. | 315/50 |
| 2008/0212325 | A1 * | 9/2008 | Wang | 362/294 |
| 2008/0253125 | A1 * | 10/2008 | Kang et al. | 362/294 |
| 2009/0021944 | A1 * | 1/2009 | Lee et al. | 362/294 |

* cited by examiner

*Primary Examiner*—John A Ward
(74) *Attorney, Agent, or Firm*—Frank R. Niranjan

(57) ABSTRACT

An LED lamp includes a heat sink, an LED module attached to a top surface of the heat sink in a thermal conductive relationship therewith and a cover coupled to the top surface of the heat sink and covering the LED module. The heat sink is column-shaped and has a central axis. The heat sink comprises a conducting member and a plurality of spaced and parallel fins extending outwardly from the conducting member. A distance between each of inner edges of the fins and the central axis is gradually decreased from the top surface to a bottom surface of the heat sink.

20 Claims, 5 Drawing Sheets

LED LAMP WITH IMPROVED HEAT SINK

BACKGROUND OF THE INVENTION

1. Field of the Invention

The present invention relates to a light emitting diode (LED) lamp, and more particularly to an LED lamp incorporating an improved heat sink which can effectively dissipate heat generated by the LED lamp, is compact and has a low cost.

2. Description of Related Art

As an energy-efficient light, an LED lamp has a trend of substituting the fluorescent lamp for indoor lighting purpose; in order to increase the overall lighting brightness, a plurality of LEDs are often incorporated into a signal lamp, in which how to efficiently dissipate heat generated by the LEDs becomes a challenge.

Some of the LED lamps directly utilize heat dissipating structures that are used for electronic components mounted in a computer, for example, CPUs, video graphic cards or hard disk drivers. A type of such heat sink which is called sunflower heat sink has a post-shaped conducting member and a plurality of fins extending outwardly and radially from a circumference of the conducting member. Such a sunflower heat sink is competent for dissipating heat generated by the electronic component mounted in the computer, since the electronic component is a single heat source. An end face of the conducting member has a surface area large enough to sufficiently contact the electronic component, whereby the heat generated by the electronic component can be instantly absorbed by the conducting member.

However, when such a sunflower heat sink is used in the LED lamp which has a plurality of LEDs and accordingly a plurality of heat sources, the end face of the conducting member can not sufficiently contact with the LEDs, whereby the heat generated by LEDs cannot be timely dissipated. To increase the diameter of the conducting member, the sunflower heat sink will become very bulky, which is unfavorable from the viewpoint of transportation and aesthetic appealing.

What is needed, therefore, is an LED lamp with an improved heat sink which can overcome the above-mentioned disadvantages.

SUMMARY OF THE INVENTION

An LED lamp includes a heat sink, an LED module attached to a top surface of the heat sink in a thermal conductive relationship therewith and a cover coupled to the top of the heat sink and covering the LED module. The heat sink is column-shaped and has a central axis. The heat sink comprises a conducting member and a plurality of spaced fins extending outwardly from the conducting member. A distance between each of inner edges of the fins and the central axis is gradually decreased from a top surface to a bottom surface of the heat sink. The fins are parallel to each other. Outer edges of the fins are coplanar with an outer circumference of the conducting member near the top surface of the heat sink.

Other advantages and novel features of the present invention will become more apparent from the following detailed description when taken in conjunction with the accompanying drawings, in which:

DETAILED DESCRIPTION OF THE INVENTION

Figure 1:
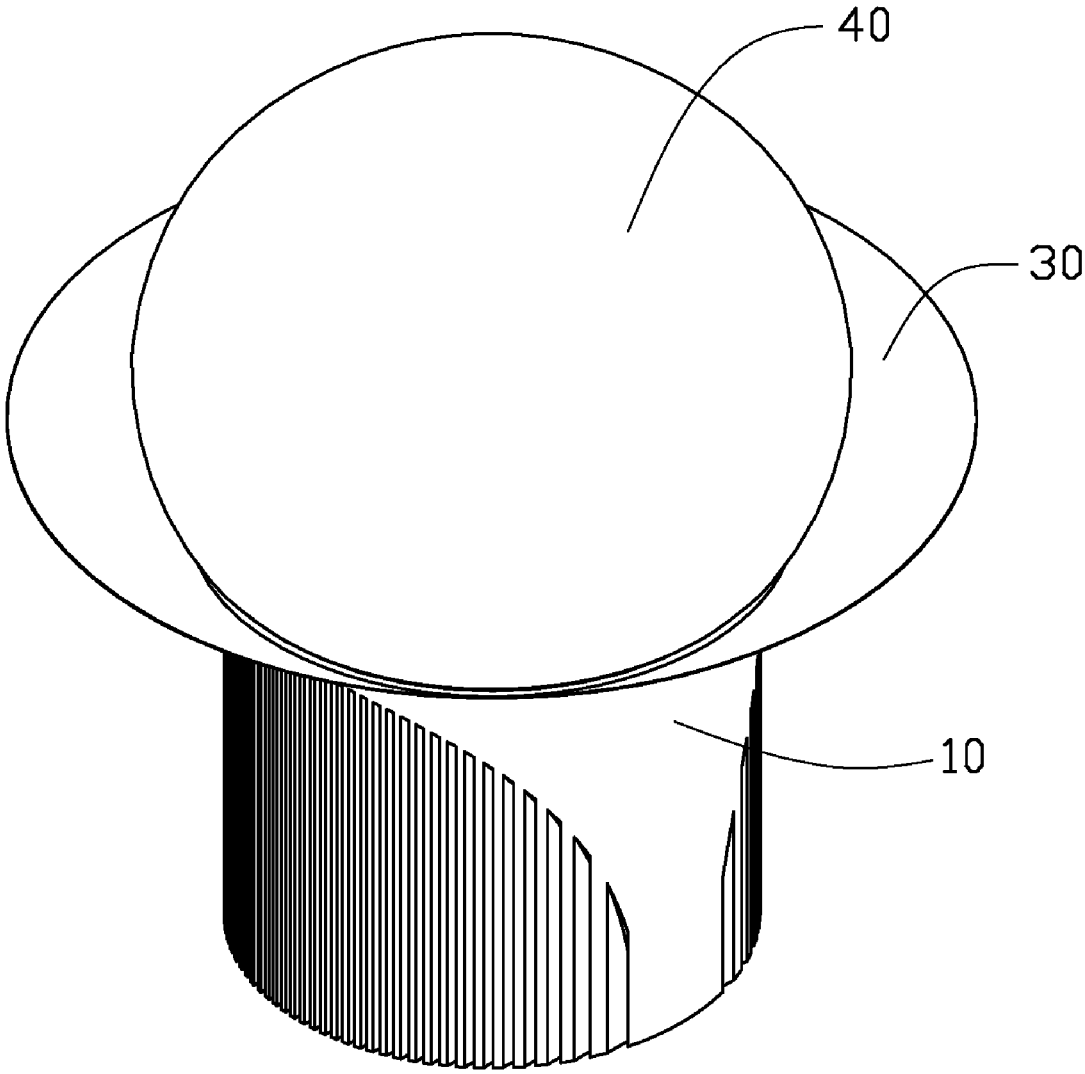
FIG. 1 is an assembled, isometric view of an LED lamp in accordance with a preferred embodiment of the present invention.
Figure 2:
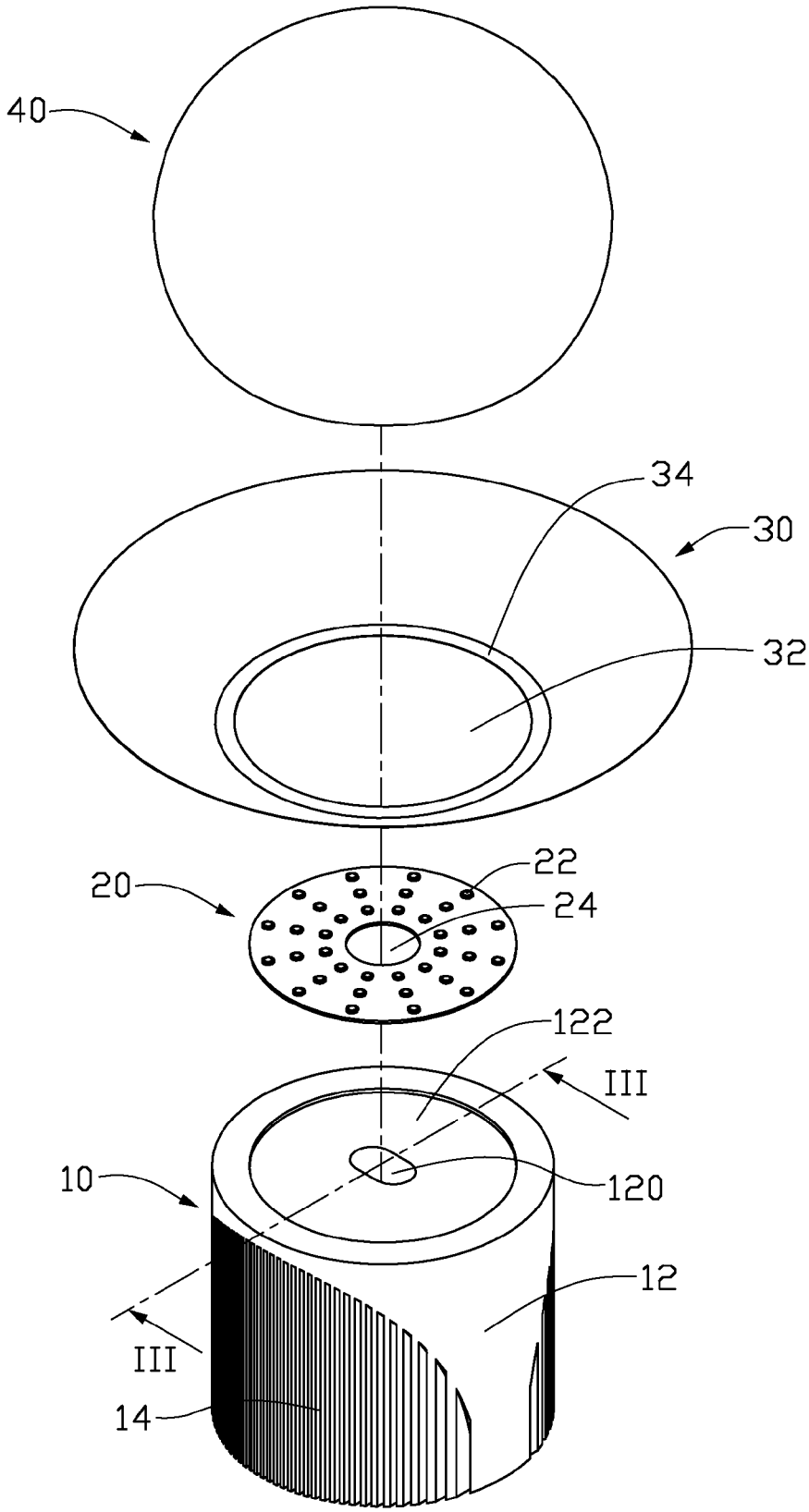
FIG. 2 is an exploded view of FIG. 1.

Referring to FIGS. 1 and 2, an LED lamp in accordance with a preferred embodiment of the present invention comprises a heat sink 10, an LED module 20 thermally attached to a top surface of the heat sink 10, a light reflector 30 mounted on the top surface of the heat sink 10 and surrounding the LED module 20 and a cover 40 enclosing the LED module 20.

Figure 3:
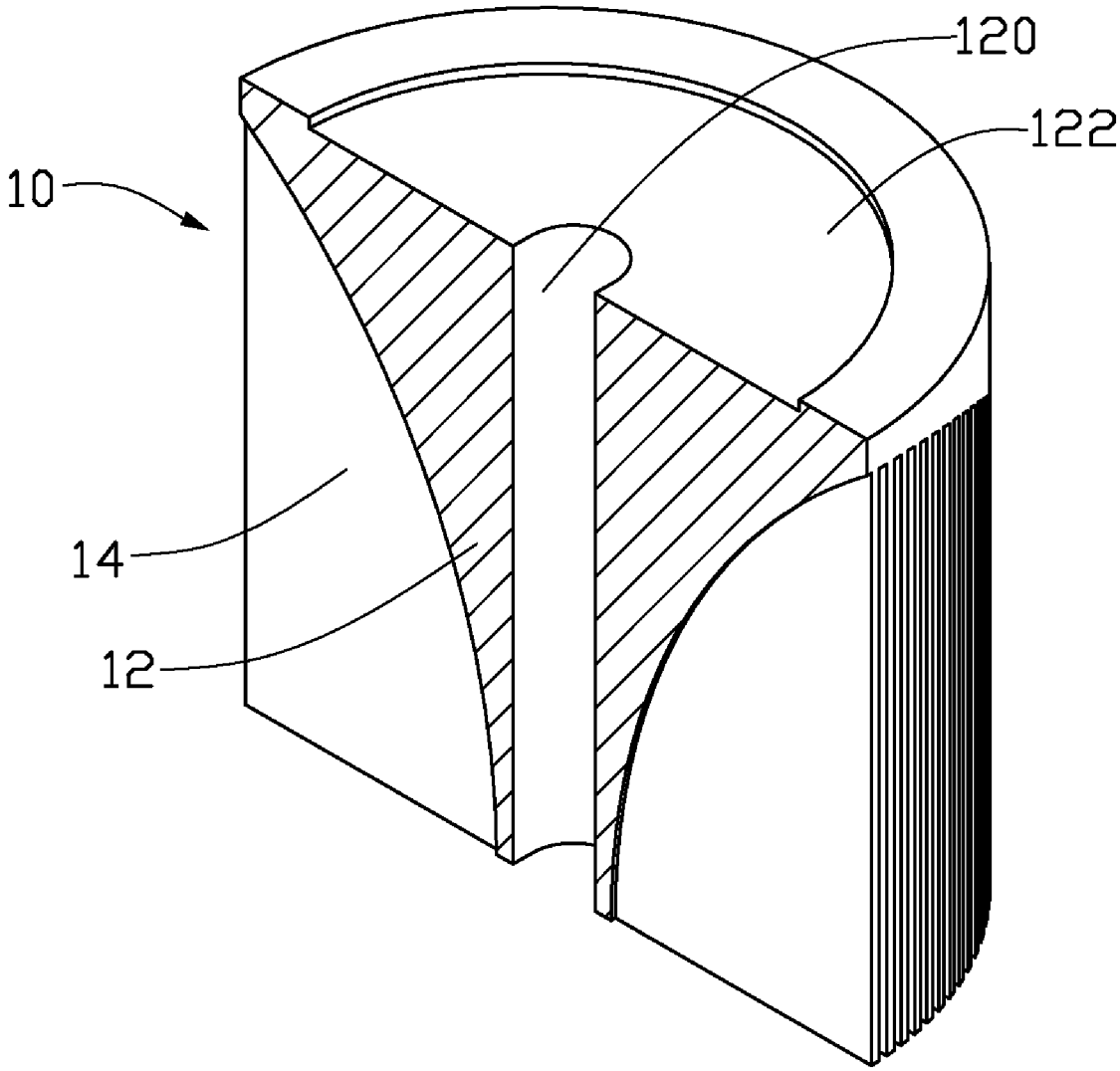
FIG. 3 is a cross-sectional view of the heat sink taken along line III-III of FIG. 2.
Figure 4:
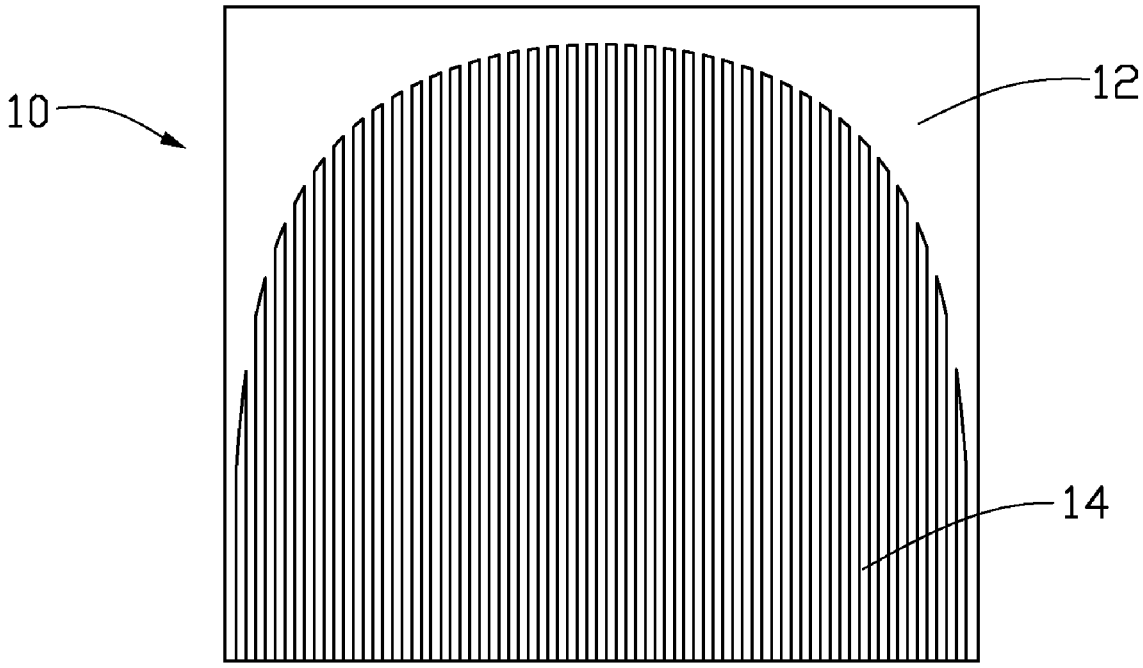
FIG. 4 is a side elevation of the heat sink of FIG. 2.
Figure 5:
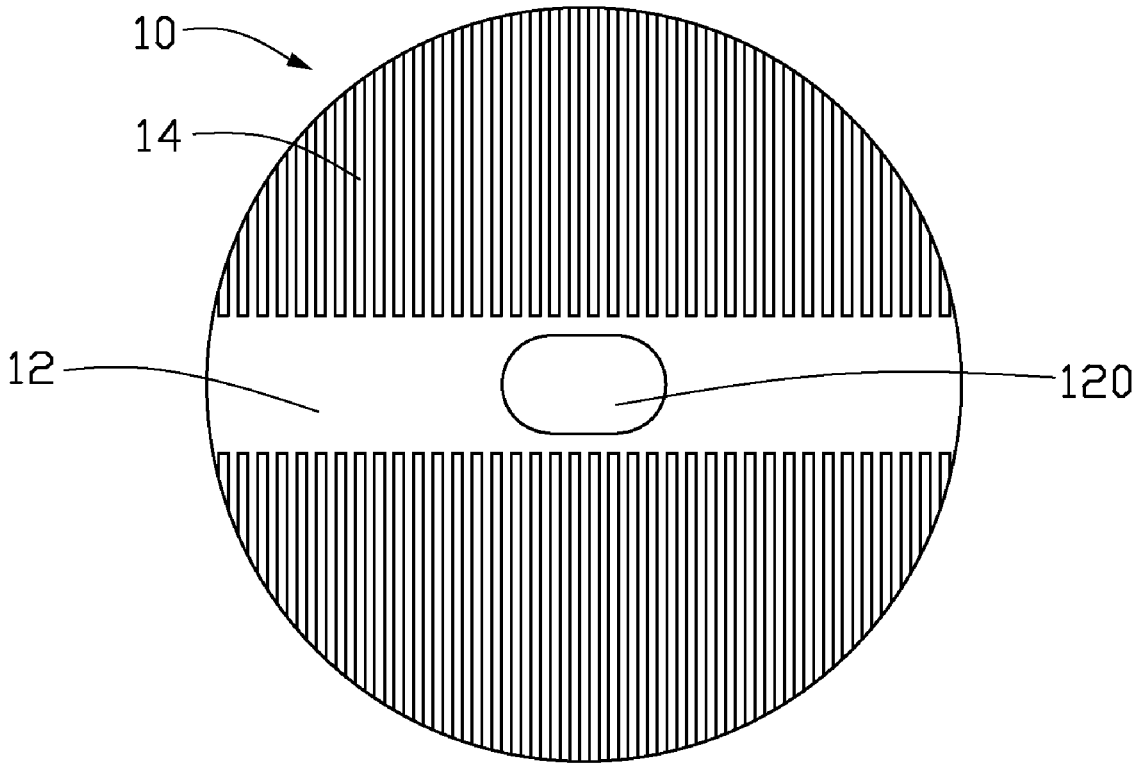
FIG. 5 is a bottom view of the heat sink of FIG. 2.

Referring to FIG. 3 to 5, the heat sink 10 is integrally formed of a material with a good heat conductivity such as aluminum and copper and is column-shaped. The heat sink 10 is centrosymmetrical relative to a central axis thereof and comprises a conducting member 12 and a plurality of parallel fins 14 extending outwardly from the heat conducting member 12. The conducting member 12 whose top surface is circular, has a strip-shaped bottom surface (shown in FIG. 5). Two opposite lateral sides of the conducting member 12 are curved surfaces and concaved toward the fins 14, symmetrical to each other relative to an imaginary central plane of the heat sink 10 through the central axis thereof. Each lateral side is recessed from a circumference of the heat sink 10 (also an outer circumference of the conducting member 12) near a top of the heat sink 10 to a bottom of the heat sink 10, and has a recessed depth gradually increased along a top-to-bottom direction of the heat sink 10. Thus, a distance between inner edges of the fins 14 and the central axis is gradually decreased from the top to the bottom of the heat sink 10. The heat sink 10 defines a tunnel 120 along the central axis thereof. The tunnel 120 is oval in cross section and symmetrical relative to the central plane of the heat sink 10. The conducting member 12 has a round contacting portion 122 recessed downwardly from a central part of the top surface thereof. The LED module 20 is received in the top surface of the conducting member 12 and contacts with the round contacting portion 122. The fins 14 extend outwardly from the two curved surfaces and are symmetrical to each other relative to the central plane of the heat sink 10. The fins 14 are formed by using a milling tool cutting through the circumference and the bottom surface of the heat sink 10 to reach the lateral sides of the conducting member 12, thereby define a plurality of parallel channels (not labeled) between every two neighboring fins 14. Outer edges of the fins 14 are coplanar with the circumference of the heat sink 10, which is coincident with the outer circumference of the conducting member 12.

Particularly referring to FIG. 2, the LED module 20 comprises an annular printed circuit board (not labeled) and a plurality of LEDs 22 mounted evenly on the printed circuit board. A circular through hole 24 is defined in a centre of the LED module 20 and has a size slightly large than that of the tunnel 120 of the heat sink 10.

The light reflector 30 facing toward the cover 40 is substantially bowl-shaped and defines a circular opening 32 in a centre of a bottom thereof. The light reflector 30 has an engaging flange 34 extending inwardly and horizontally to surround the opening 32. The engaging flange 34 is designed to be suitable for being coupled to the top surface of the heat sink 10 and surrounding the contacting portion 122 of the heat sink 10 on which the LED module 20 is mounted.

The cover 40 is globose and made of transparent plastic or glass. The cover 40 is formed with a receiving opening (not shown) at a bottom thereof. A fixing flange (not shown)

extends inwardly and horizontally from the bottom of the cover 40 and surrounds the receiving opening. The fixing flange is coupled with the engaging flange 34 of the light reflector 30 when assembling the cover 40 to the LED lamp.

In assembly of the LED lamp, the LED module 20 is mounted on the contacting portion 122 of the heat sink 10 and secured via screws (not shown) or adhering. In order to enhance a thermal exchanging ability between the LED module 20 and the heat sink 10, thermal grease is preferred to be filled between a bottom surface of the LED module 20 and the contacting portion 122. The light reflector 30 is secured on the top surface of the heat sink 10 by the engaging flange 34 being coupled to the top surface of the heat sink 10 and surrounding the LED module 20. The fixing flange of the cover 40 is fixed to the engaging flange 34 of the light reflector 30; thus, the cover 40 can securely cover the LED module 20.

In use of the LED lamp, when the LED module 20 is activated to generate light, the LED module 20 generates a mass of heat which is simultaneously absorbed by the conducting member 12 of the heat sink 10 and then evenly delivered to the fins 14 to be dissipate into ambient air via the fins 14, whereby the LED module 20 is cooled duly and timely, and the LEDs 22 can thus function normally. As the heat sink 10 is mainly formed by cutting a solid block with a column configuration, the heat sink 10 can be easily and economically formed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp comprising:

a heat sink being column-shaped and having a central axis, the heat sink comprising a conducting member and a plurality of spaced fins extending from the conducting member, wherein a distance between inner edges of the fins and the central axis is gradually decreased from a top surface to a bottom surface of the heat sink, and the inner edges of the fins each have an arc-shaped configuration and are gradually away from the central axis of the heat sink along a bottom-to-top direction of the heat sink; and an LED module attached to the top surface of the heat sink in a thermal conductive relationship therewith; and a cover coupled to the top surface of the heat sink and covering the LED module.

2. The LED lamp as claimed in claim 1, wherein outer edges of the fins are coplanar with a circumference of the heat sink.

3. The LED lamp as claimed in claim 1, wherein the fins are parallel to each other.

4. The LED lamp as claimed in claim 1, wherein the heat sink is centrosymmetrical relative to the central axis thereof.

5. The LED lamp as claimed in claim 4, wherein heat sink has a tunnel extending therethrough, the fins and the tunnel are symmetrically formed in respect to an imaginary central plane of the heat sink extending through the central axis thereof.

6. The LED lamp as claimed in claim 1, wherein a bottom surface of conducting member of the heat sink is strip-shaped.

7. The LED lamp as claimed in claim 1, wherein the heat sink defines an oval tunnel extending along the central axis thereof.

8. The LED lamp as claimed in claim 1, wherein the heat sink has a circular contacting portion recessed from a central part of the top surface thereof and contacting the LED module.

9. The LED lamp as claimed in claim 1, further comprising a light reflector sandwiched between the top surface of the heat sink and the cover, and surrounding the LED module.

10. The LED lamp as claimed in claim 9, wherein the light reflector is bowl-shaped, defines a circular opening in a centre of a bottom thereof and has an engaging flange extending inwardly and horizontally to surround the opening, and the engaging flange is coupled to the top surface of the heat sink.

11. The LED lamp as claimed in claim 1, wherein the cover is globose and made of transparent material.

12. A heat sink adapted for removing heat from LEDs comprising:

a conducting member having a circular top surface, a strip-shaped bottom surface and two opposite lateral sides recessing gradually from a circumference thereof near the circular top surface toward the bottom surface thereof; and a plurality of fins extending outwardly from the two lateral sides of the conducting member;

wherein outer edges of the fins are coplanar with the circumference of the conducting member, and inner edges of the fins each have an arc-shaped configuration and are gradually away from a central axis of the heat sink along a bottom-to-top direction of the heat sink.

13. The heat sink as claimed in claim 12, wherein the heat sink is column-shaped.

14. The heat sink as claimed in claim 13, wherein the fins are parallel to each other, the fins and the two lateral sides of the conducting member are symmetrical to each other relative an imaginary central plane extending through the central axis of the heat sink.

15. The heat sink as claimed in claim 14, wherein the two lateral sides are gradually away from the central plane in a direction from the bottom surface toward the top surface of the heat sink.

16. A heat sink comprising a column-shaped heat conducting member having a column-shaped upper portion and a lower extension portion extending downwardly from the upper portion, the lower extension portion defining two recessed lateral side surfaces and a plurality of fins extending outwardly from the two lateral side surfaces of the lower extension portion, inner edges of the fins each having an arc-shaped configuration and being gradually away from a central axis of the heat sink along a bottom-to-top direction of the heat sink.

17. The heat sink as claimed in claim 16, wherein the upper portion has a continuous top surface, and bottom ends of the fins of the lower extension portion cooperatively constitute a discontinuous bottom surface opposite to the top surface.

18. The heat sink as claimed in claim 17, wherein outer edges of the fins are coplanar with a lateral side surface of the upper portion of the heat sink.

19. The heat sink as claimed in claim 18, wherein the outer edges of the fins and the lateral side surface of the upper portion cooperatively form a discontinuous cylindrical surface.

20. The heat sink as claimed in claim 16, wherein the fins are parallel to each other.

* * * * *